US006688947B2

(12) United States Patent
Anand et al.

(10) Patent No.: US 6,688,947 B2
(45) Date of Patent: Feb. 10, 2004

(54) POROUS, LUBRICATED NOZZLE FOR ABRASIVE FLUID SUSPENSION JET

(75) Inventors: Umang Anand, Baltimore, MD (US); Joseph Katz, Baltimore, MD (US)

(73) Assignee: The Johns Hopkins University, Baltimore, MD (US)

( * ) Notice: Subject to any disclaimer, the term of this patent is extended or adjusted under 35 U.S.C. 154(b) by 56 days.

(21) Appl. No.: 10/067,591

(22) Filed: Feb. 5, 2002

(65) Prior Publication Data

US 2003/0148709 A1 Aug. 7, 2003

(51) Int. Cl.[7] ..... B24B 1/00; B24C 5/04

(52) U.S. Cl. ..... 451/40; 451/38; 451/53; 451/56; 451/102; 451/449

(58) Field of Search ..... 83/53, 177; 239/596, 239/600, 302, 335, 336; 451/38, 39, 36, 37, 40, 53, 56, 102, 449

(56) References Cited

U.S. PATENT DOCUMENTS

| | | | | |
|---|---|---|---|---|
| 5,505,653 A | | 4/1996 | Nedo et al. | 451/5 |
| 5,662,266 A | * | 9/1997 | Zurecki et al. | 239/8 |
| 5,860,849 A | | 1/1999 | Miller | 451/40 |
| 5,921,846 A | | 7/1999 | Katz | 451/28 |
| 6,119,964 A | | 9/2000 | Lombari | 239/418 |

OTHER PUBLICATIONS

Tan & Davidson, "Cutting By Sand–Water Jets From A Fluidized Bed," Chpt. 15, Proceedings of the 10th International Symposium, Oct. 13–Nov. 2, 1990.

Tan, "A Model For Liquid–Particle Jet Flow In A Porous Re–Entrant Nozzle," International Journal of Water Jet Technology, pp. 97–102, Apr. 1995.

Tan, "Discharge of Particle–Liquid Jets Through Porous Converging Nozzles," International Journal of Water Jet Technology, pp. 13–19, Dec. 1998.

* cited by examiner

*Primary Examiner*—Timothy V. Eley
(74) *Attorney, Agent, or Firm*—Larry J. Guffey

(57) ABSTRACT

A nozzle apparatus for use with an abrasive fluid jet cutting system, and its method of construction and operation, are disclosed that reduce the wear and erosion problems typically experienced in the cutting jet's nozzle. This improved nozzle apparatus comprises (a) a nozzle having an entry port for receiving a slurry consisting of a carrier fluid and abrasive particles, an inner wall for directing the flow of the slurry, and an outlet port through which the slurry exits the nozzle, (b) wherein at least a portion of the nozzle wall is porous, and (c) a lubricating fluid chamber that surrounds the porous portion of the outer wall of the nozzle, the chamber having a port where a lubricating fluid enters the chamber, with the chamber port connecting to an input pipe which connects to a filter for filtering contaminants that might clog the pores of the porous portion of the nozzle. The nozzle operates by having the lubricating fluid pass from the lubricating reservoir and through the porous wall to lubricate at least a portion of the surface of the nozzle inner wall so as to resist erosion of the wall, as well as result in an abrasive slurry jet with improved coherence and cutting efficiency.

54 Claims, 7 Drawing Sheets

POROUS, LUBRICATED NOZZLE FOR ABRASIVE FLUID SUSPENSION JET

BACKGROUND OF THE INVENTION

1. Field of the Invention

This invention relates to fluent abrading processes and apparatus. More particularly, this invention relates to an improved nozzle for an abrasive fluid jet cutting apparatus.

2. Description of the Related Art

Cutting with water is a well-known technology that has been prevalent since the 1970's. Water jet cutting is one of a number of technologies known as power beams. These include laser cutting, plasma arc cutting and oxy-acetylene gas cutting.

By utilizing a high-pressure pump to pressurize water to ultra high pressures and then forcing the water to flow through a tiny orifice, one can produce water jets that have velocities that are up to three times the velocity of sound. Such a focused water jet has sufficient kinetic energy to cut through most hard-to-cut materials, and when abrasives are mixed with the water flow so as to yield an abrasive water jet, one can efficiently cut almost any type of material.

Because of their greater cutting power, abrasive water jets account for nearly sixty percent of the water jet cutting market. Typical applications include the cutting tasks associated with fabrication of structures using extremely hard materials, such as titanium and the super-alloys, and in various mining and drilling applications where hard rocks must be cut. Meanwhile, plain water jets are used for industrial cleaning, surface preparation and paint stripping applications, and for the cutting of food products, paper and plastic materials, and woven (e.g., carpet) and nonwoven (e.g., filtration materials) products. Saline, water cutting jets have also been used in medical applications.

The primary equipment associated with a typical, abrasive water jet cutting system is shown in FIG. 1. It consists of an incoming water treatment system, a booster pump for optimal operation of downstream filters, an intensifier pump that raises the water's pressure to ultrahigh levels, high pressure plumbing that delivers the ultrahigh pressure water to the system's cutting head, an abrasive feeder system that supplies the abrasive particles that are mixed with the water either before or in the cutting head, and an outgoing water catcher and treatment system.

Two types of cutting heads for abrasive water jets are in common use today. These are denoted as either an abrasive entrainment jet (AEJ) head or an abrasive suspension jet (ASJ) head.

The abrasive entrainment jet (AEJ) head utilizes an orifice constructed from a very hard material (e.g., sapphire, diamond) to create a high velocity water jet. A dry abrasive, such as garnet, silica or alumina, is then aspirated or entrained into the mixing chamber by the vacuum created by the water jet. It mixes with the water jet and the mixed slurry jet is then collimated by a mixing tube (also called a focusing tube) before exiting the cutting head through the mixing tube's exit orifice. See FIG. 2 for cross-sectional view of the typical AEJ head that is used in an abrasive water jet cutting system.

The abrasive suspension jet (ASJ) head utilizes a premixed slurry of abrasives and water from which to create a high velocity jet by forcing the premixed slurry through an orifice or nozzle that is typically made of diamond. See FIG. 3 for cross-sectional view of the typical ASJ head that is used in an abrasive water jet cutting system.

Despite the apparent similarities between these cutting heads, they possess significant operational and performance differences. These include:

(a) the mixing process in an AEJ is extremely inefficient and only a fraction of the energy of the high-speed water is transmitted to the abrasive particles. Hence, the speed of the collimated jet is substantially reduced. In an ASJ however, the energy transfer is quite effective resulting in higher particle velocities. For similar hydraulic and suspension concentration parameters the specific cutting power (particle's kinetic power per unit jet diameter) of an ASJ is four times that of an AEJ;

(b) the process of entrainment by a vacuum in an AEJ limits the amount of abrasives that can be added to the jet and this results in a sparse distribution of particles in the cutting jet. Also, the particle velocities in an AEJ decrease as the abrasive mass flow increases. Higher abrasive mass flow rates can be pumped with an ASJ, which improves their cutting effectiveness;

(c) the entrained abrasives in an AEJ becomes fragmented during the mixing process as a result of the higher-velocity water jet hitting them. Since the cutting effectiveness of the jet has been shown to increase with the size of the abrasive particles, the reduced size particles hitting a workpiece make the AEJ less efficient than it might otherwise be;

(d) for a small diameter AEJ to have sufficient abrasive particle entrainment capabilities, it must be operated at high pressures;

(e) an ASJ is capable of utilizing a smaller orifice diameter, which means that the cutting width of such a jet can be smaller than that of a comparable strength AEJ, and (f) For the same abrasive particle velocity, an ASJ utilizes lower pressure pumps than an AEJ. An ASJ can better handle operation with dirty water than can an AEJ, as the AEJ needs highly purified water and clean operating conditions to raise the carrier fluid (water) pressure to ultra high pressures.

Both AEJ and ASJ cutting heads are plagued by the wear and erosion problems that are associated with their use of abrasive particles. Even using very hard materials, the high speed of the fluid through such cutting heads can rapidly destroy the ASJ's nozzle or the AEJ's mixing tube. Further, as these cutting head elements erode, the cutting jet's kerf, or width of cut, changes, as does the dispersion of the fluid upon exiting from the cutting heads. Consequently, the nozzle and mixing tube elements of the respective ASJ and AEJ heads must be replaced frequently, resulting in constant maintenance and inspection, loss of accuracy, and machine down time, all of which add to the cost of using such cutting apparatus.

Prior attempts to solve this wear problem have generally concentrated on trying the minimize the damage resulting from the occurrence of abrasive particle-to-adjoining wall-contact. Means to accomplish this have included seeding a pure liquid jet with abrasive particles only downstream of the nozzle, use of nozzles and mixing tubes made of very hard materials (such as diamonds, sapphire and tungsten carbide), using abrasive particles that are softer than the nozzle or mixing tube walls, and attempting to modify the flow structure through these elements in order to keep abrasive particles away from the wall surfaces. All of the presently available techniques have major deficiencies.

Seeding downstream of the nozzle reduces the speed of the abrasive particles, and causes considerable expansion, scattering, and unsteadiness of the fluid flow. Nozzles fabricated from very hard materials are expensive and almost impossible to form into desirable shapes. Use of abrasive particles softer than the adjoining walls reduces cutting efficiency. Modification to the jet flow structure by introducing secondary swirling flows near the adjoining walls is useful only with relatively slow flows and small abrasive particles; such modification also causes jet expansion and secondary flow phenomena that limit the capability to control the process. Attempts have also been made to try to minimize the actual occurrence of abrasive particle-to-adjoining wall-contact. Tan and Davidson (1990) and Tan (1995 and 1998) suggested the use of porous nozzles in cutting jet applications. They studied flows through porous nozzles at low operating pressure (1–2 MPa) and where the fluid flowing through the porous walls, which was water, was of the same approximate viscosity as the carrier fluid for the abrasive particles. Because these studies were performed at low pressures (i.e., at low velocities), it is impossible to extrapolate their results to predict how such porous nozzles might perform under the typical, high pressure conditions encountered in commercial cutting jet applications. Also, it has been found from the research associated with the development of the present invention that water does not have sufficiently high viscosity to prevent wear in the nozzles. In fact, lubricants with viscosities that are three orders of magnitude higher than that of water are essential. Furthermore, the use of the same water containing particles on both sides of the nozzle (i.e., as the carrier fluid in the jet and as the lubricant through the porous medium) have been found to quickly clog the porous medium after a very short time.

U.S. Pat. No. 5,921,846 to Katz discloses the use of porous nozzles for ASJ cutting head applications. Appreciable reductions in cutting head wear problems are found to be achievable by introducing lubricating, high viscosity fluids through the porous walls at lubricating fluid flow rates that are considerably less than that of the carrier fluid in the cutting jet itself. However, despite their low erosion benefits, such porous nozzles with their lubricating, high viscosity flows, apparently have not yet found acceptance in any commercial or R&D applications.

Thus, despite extensive development efforts to reduce wear in abrasive fluid cutting heads, there exists a continuing need for further improvements in this area. The present invention provides such improvements for the abrasive suspension jet (ASJ) head.

SUMMARY OF THE INVENTION

Recognizing the need for the development of an improved nozzle which would have greater resistance to being worn away by the abrasive slurry mixtures flowing through them, the present invention is generally directed to satisfying the needs set forth above and overcoming the disadvantages identified with prior art devices.

In accordance with one preferred embodiment of the present invention, the foregoing need can be satisfied by providing a nozzle apparatus for use with an abrasive fluid jet cutting system, the nozzle apparatus comprising: (a) a nozzle having an entry port for receiving a slurry consisting of a carrier fluid and abrasive particles, an inner wall for directing the flow of the slurry, and an outlet port through which the slurry exits the nozzle, (b) wherein at least a portion of the nozzle wall is porous, (c) a lubricating fluid chamber that surrounds the porous portion of the outer wall of the nozzle, the chamber having a port where a lubricating fluid enters the chamber, with the chamber port connecting to an input pipe which connects to a filter for filtering contaminants from the lubricating fluid that might clog the pores of the porous portion of the nozzle wall, and (d) wherein the lubricating fluid passes from the lubricating reservoir and through the porous wall to lubricate at least a portion of the surface of the nozzle inner wall so as to resist erosion of the wall while the slurry is flowing through the nozzle.

According to a second embodiment of the present invention, a method is provided for reducing erosion on the inner wall of the nozzle used in an abrasive fluid jet cutting system. The method comprises the steps of: (a) forming the nozzle so that at least a portion of it is porous, (b) surrounding at least a portion of the outer wall of the nozzle with a lubricating fluid reservoir, (c) forcing lubricating fluid to pass from the lubricating reservoir and through the porous wall to form a lubricating film between the nozzle wall and the flow of abrasive slurry, (d) wherein the lubrication fluid having been filtered to eliminate contaminants from the fluid that might clog the pores of the porous portion of the nozzle.

There has been summarized above, rather broadly, the more important features of the present invention in order that the detailed description that follows may be better understood and appreciated. In this regard, it is instructive to also consider the objectives of the present invention.

Thus, it is an object of the present invention to provide an abrasive, fluid suspension jet cutting apparatus, and its method of construction and operation, that reduces the wear and erosion problems experienced in the cutting jet's nozzle.

It is another object of the present invention to provide a nozzle than can replace the nozzles currently used in abrasive, fluid suspension jet cutting apparatus SO as to minimize the wear and erosion problems associated with such nozzles.

It is another object of the present invention to provide an abrasive, fluid suspension jet cutting apparatus and its method of construction and operation that will expand the usefulness of such jet cutters by increasing the precision and efficiency of their cuts.

It is yet another object of the present invention to provide an abrasive, fluid suspension jet cutting apparatus and its method of construction and operation that will expand the range of applications of such jet cutters.

It is a further object of the present invention to provide a method and device for abrasive cutting that will increase the cost effectiveness of such cutting processes.

These and other objects and advantages of the present invention will become readily apparent as the invention is better understood by reference to the accompanying drawings and the detailed description that follows.

Thus, there has been summarized above, rather broadly, the more important features and objectives of the present invention in order that the detailed description that follows may be better understood and appreciated. There are, of course, additional features of the invention that will be described hereinafter and which will form the subject matter of any eventual claims to this invention.

DESCRIPTION OF THE PREFERRED EMBODIMENT

Figure 1:
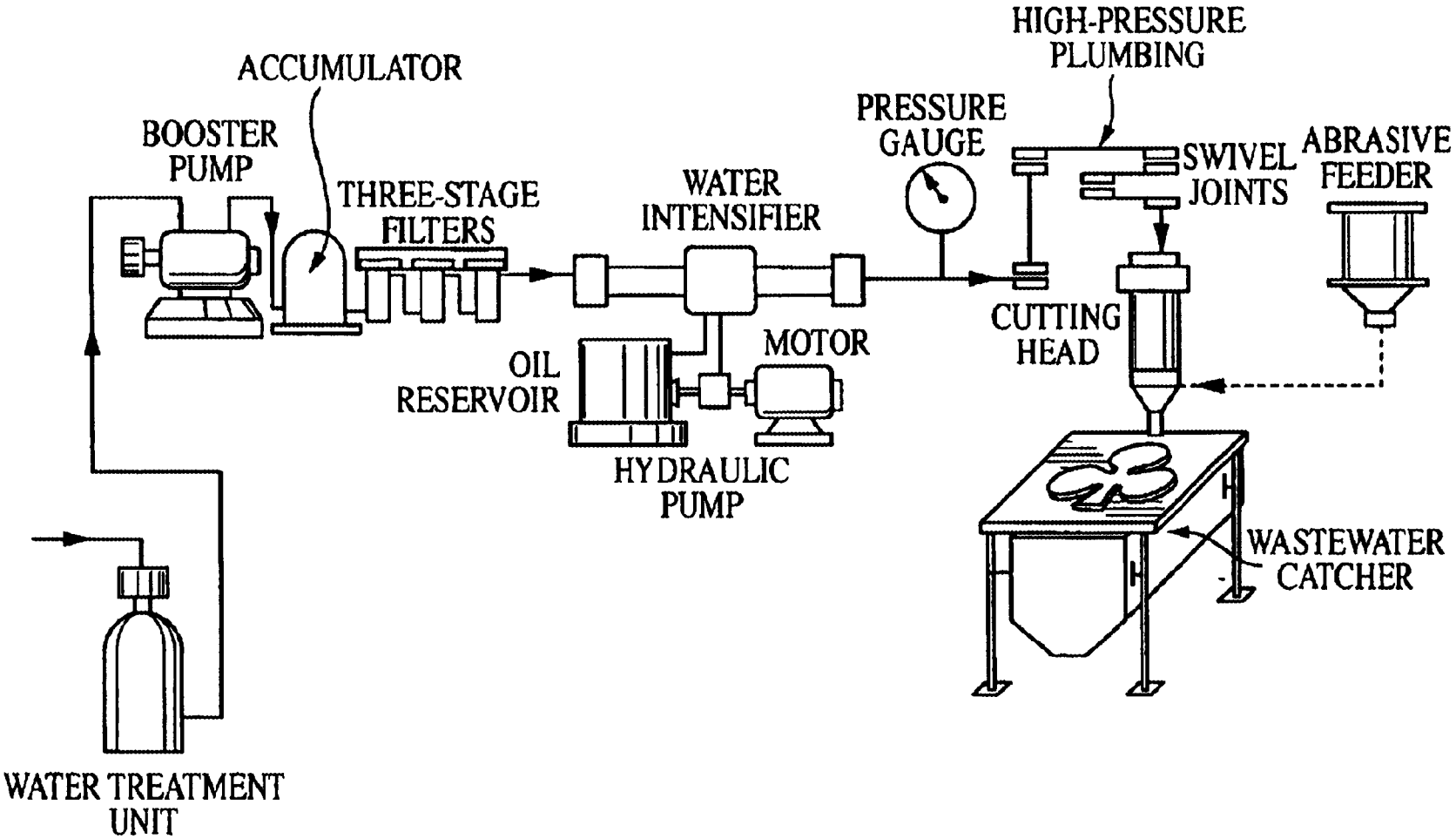
FIG. 1 is a schematic representation of the components of a typical abrasive water jet cutting system.
Figure 2:
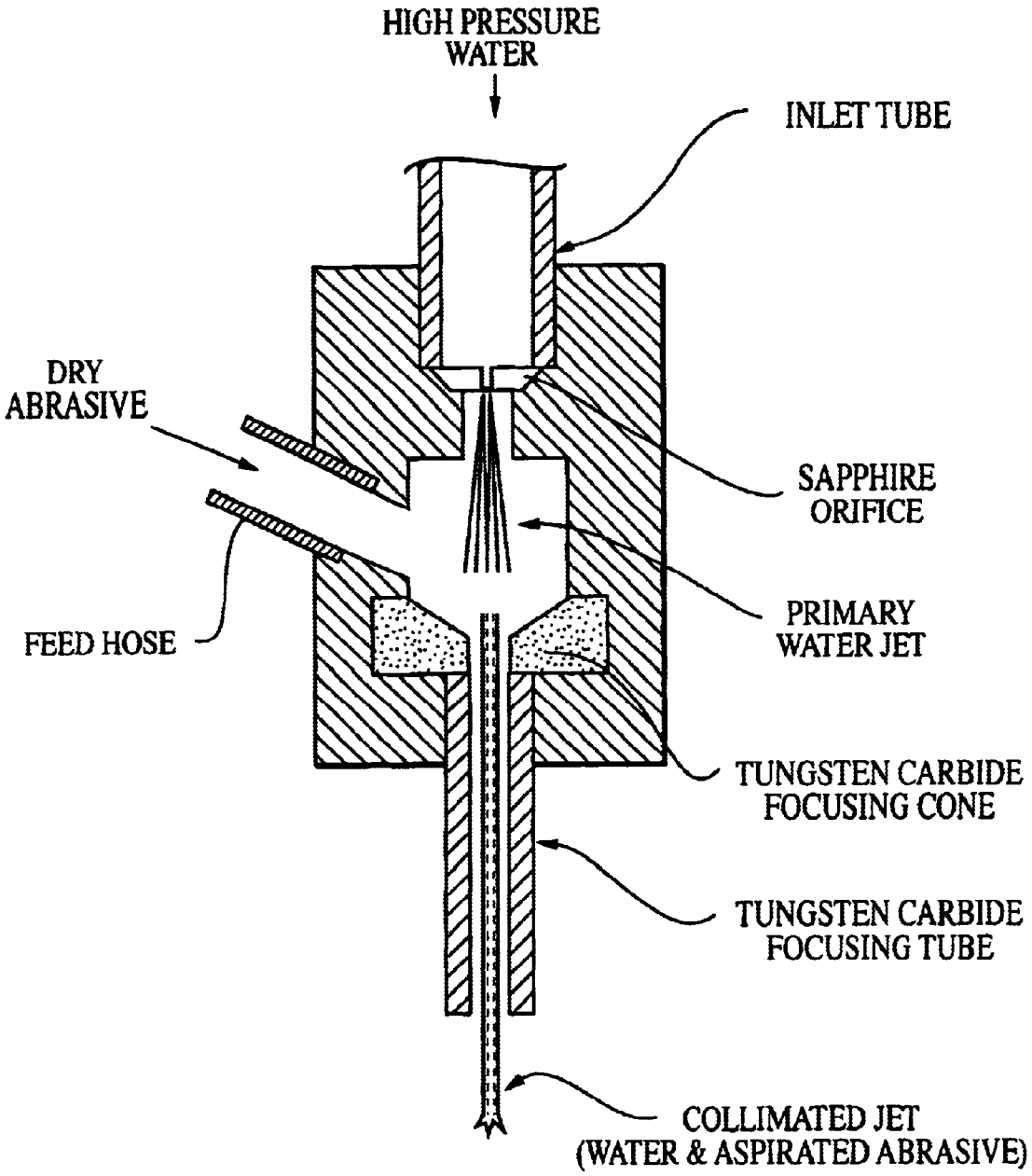
FIG. 2 is a cross-sectional view of the typical abrasive entrainment jet (AEJ) cutting head.
Figure 3:
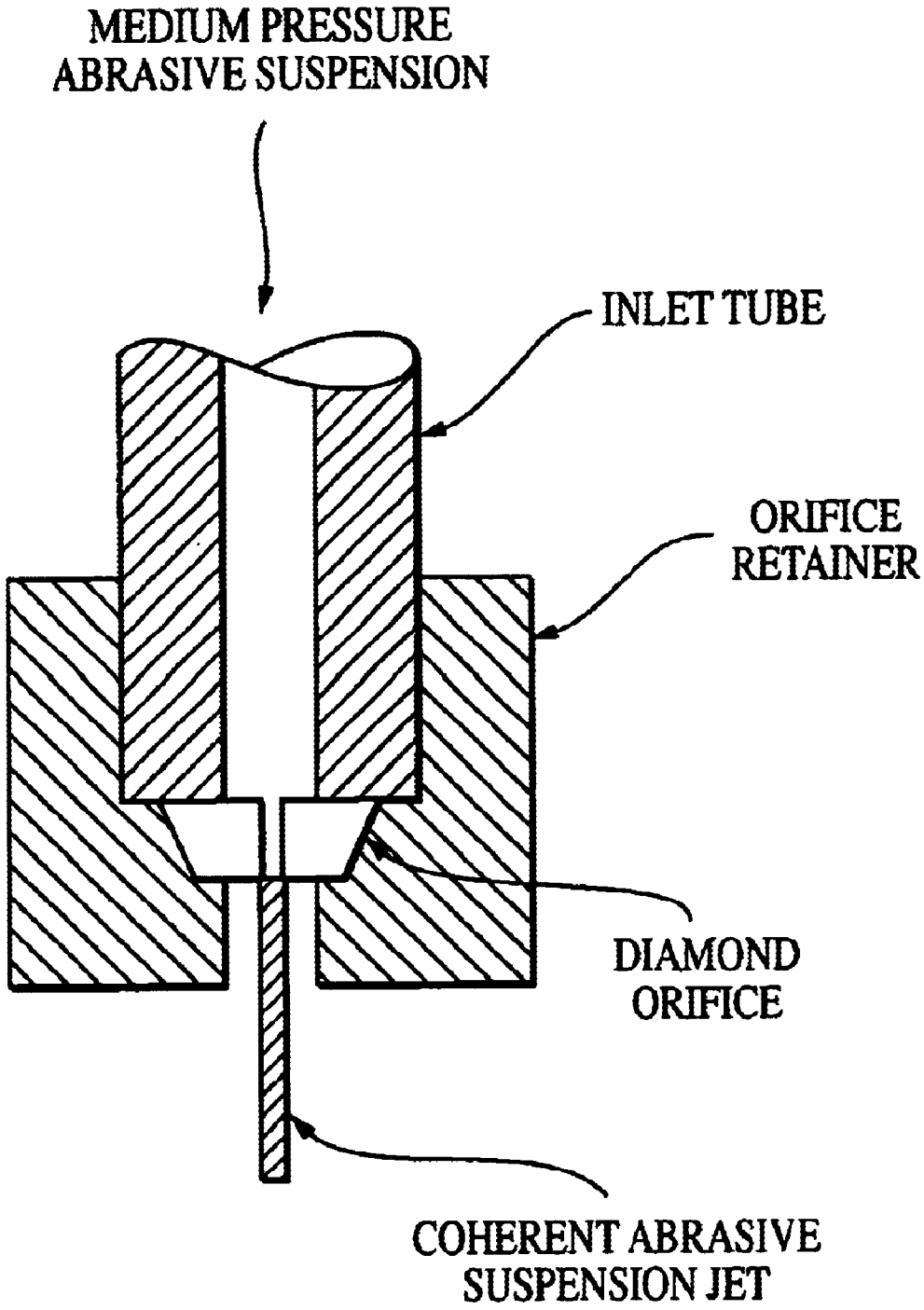
FIG. 3 for cross-sectional view of the typical abrasive suspension jet (ASJ) cutting head.

Before explaining at least one embodiment of the present invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

Figure 4:
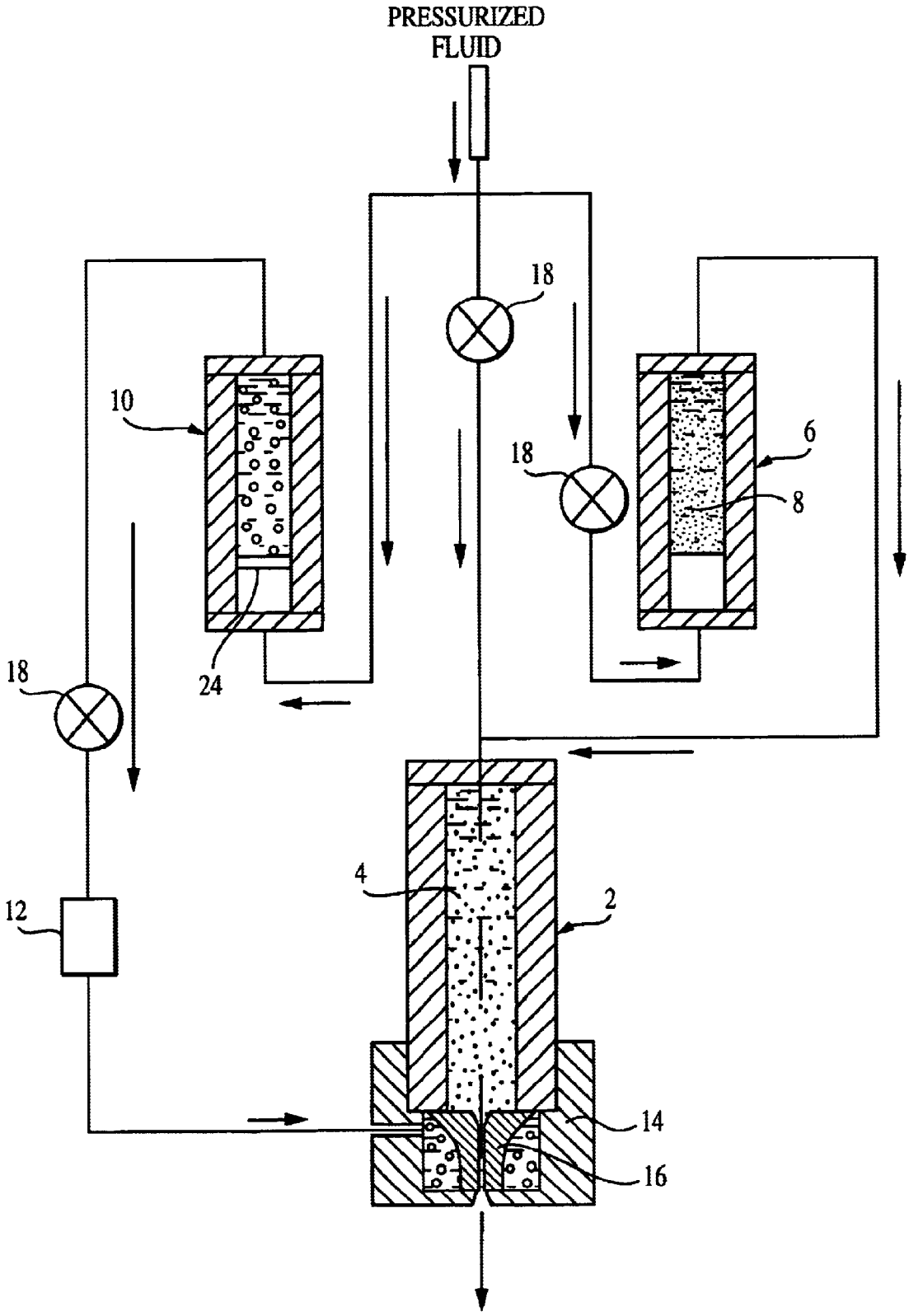
FIG. 4 is a cross-sectional view of a preferred embodiment of an abrasive water jet cutting apparatus of the present invention

Referring now to the drawings wherein are shown preferred embodiments and wherein like reference numerals designate like elements throughout, there is shown in FIG. 4 a block diagram of one embodiment of the abrasive suspension cutting jet system of the present invention. A carrier fluid, such as water, is pressurized (e.g., by a high pressure hydraulic pump) and introduced to a cutting head 2 having a slurry mixing chamber 4. The pressurized fluid is also used to pressurize a high density slurry source 6 containing abrasive particles 8 at a concentration of approximately 10–20% by volume; however, other ratios may be used. The abrasive particles 8 may be, for example, fine silica, aluminum oxide, garnet, tungsten carbide, silicon carbide and similar materials.

The outlet of the high density slurry source 6 is coupled to the slurry mixing 22 chamber 4 of the cutting head 2, where the slurry is diluted by the pressurized fluid, typically to about 1–5% by volume. In the preferred embodiment, the pressurized fluid is also used to pressurize a lubricant source 10, with a piston 24 separating the lubricant from the pressurized fluid, the output of which passes through a 2-micron, stainless steel filter 12 and then flows into a lubricant chamber 14 surrounding a nozzle 16. The nozzle 16 forms one end of the cutting head 2. Manual or automated valves 18 are used to regulate the relative flow rates and pressure of fluid, slurry, and lubricant to the cutting head 2.

Figure 5:
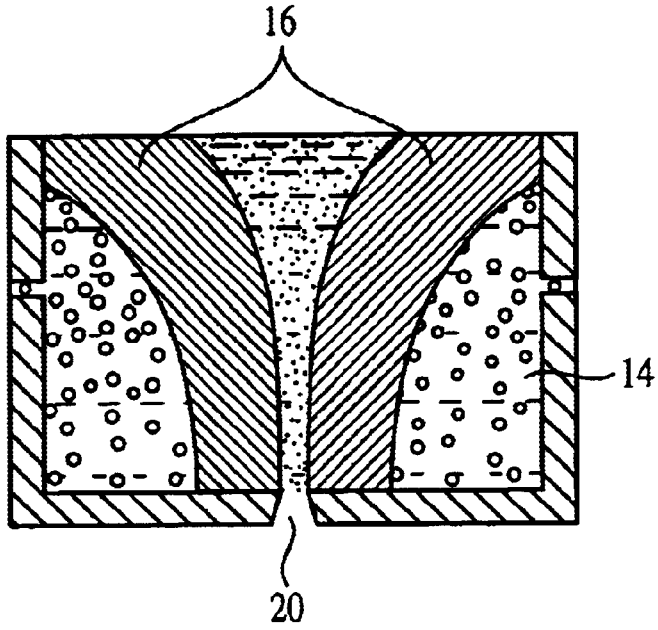
FIG. 5 is a cross-sectional view of a preferred embodiment of the porous nozzle of the distal end of the cutting head.

Referring to FIG. 5, shown in close-up is the distal end of the cutting head 2. In the preferred embodiment, it consists of a nozzle 16 which is formed of a porous material. The filter 12 in the system's lubrication line is necessary to remove any dirt or contamination present in the supply line or in the lubricant so as to minimize plugging of the nozzle's pores.

Figure 6:
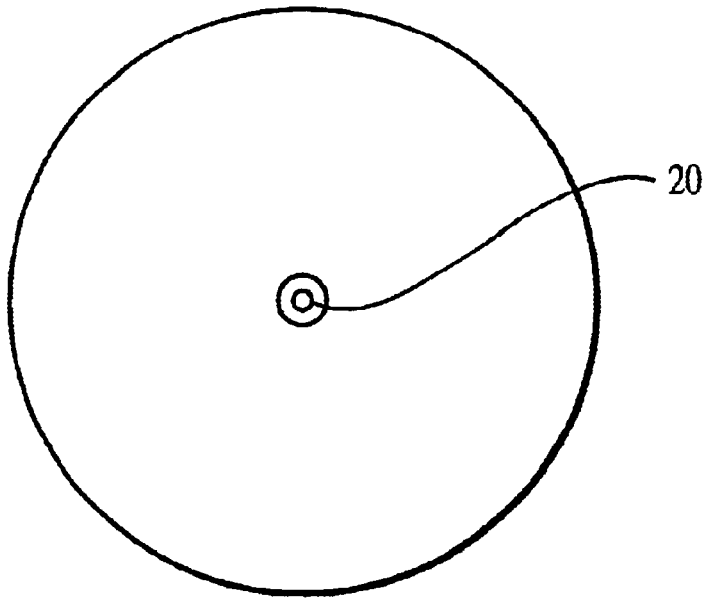
FIG. 6 is an end view of the axisymmetric nozzle shown in FIG. 5.

In the embodiment shown in FIG. 6, the distal end of the nozzle 16 defines an approximately circular jet orifice 20, from which the slurry cutting jet exits the cutting head 2. In a typical embodiment, the smallest cross-sectional dimension (i.e., the diameter, if round) of the jet orifice 20 is in the range of 50 to 3,000 micrometers. Because of the improved performance characteristics resulting from the present invention, the smallest cross-sectional dimension may be as little as twice the diameter of the abrasive particles (presently, fine abrasive particles are typically about 20 micron).

The materials and techniques used in the fabrication of the porous materials, from which the nozzles were formed, proved to be critical to the efficient operation of this abrasive suspension cutting jet system. Various types of porous metals (e.g., 316 stainless steel, 10-micron grade materials made by a pre-compaction sintered process into disc and sheet forms, and made by a gravity sintered process into a sheet form) were studied to identify those that yielded the most uniform distribution of pores on the surface of the material along with a high pore density. Alternately, it would be possible to form the nozzles by using casting or molding techniques with other materials, such as porous ceramics.

For a specific grade of porous material (Grades are available in 0.2, 0.5, 1, 2, 5, 10, 20 and 40 microns), it was found that the porous sheet materials that were produced using the gravity sintering process exhibited both greater pore density and surface pore uniformity. Hence, for the same nominal pore grade, the gravity sintered material was better for use in the present invention than the pre-compacted sintered material. Sheets of porous 316 stainless steel, 10-micron grade, gravity sintered material were used in fabricating the porous nozzles that were used in the present invention's experiments to evaluate nozzle wear.

Additionally, it was found that the means used for fabricating a desired nozzle from the selected porous metals is also critical to the efficient operation of the abrasive suspension cutting jet system disclosed herein. Conventional machining processes, such as milling, drilling, boring, etc., as well as other non-conventional machining techniques such as laser cutting, water jet cutting, etc., were found to smear the surfaces of the porous metals so as to clog the surface's pores and greatly diminish the surface's porosity. During nozzle fabrication, the surface porosity of the porous metals could only be maintained by using very precise and experimentally determined, wire or sink Electric Discharge Machining (EDM) techniques.

Those knowledgeable of the EDM machining process will understand that it is primarily controlled by the following parameters: cutting speed/electrode feed rate, spark cycle, spark energy level, wire electrode speed, wire tension and coolant conductivity. The effects of varying these parameters during fabrication of a nozzle, made from sheets of porous 316 stainless steel, 10-micron grade, gravity sintered material, were investigated.

For a wire EDM machine and with the coolant conductivity set for stainless steel, it was found that the spark energy level and the cutting speed should be as low as possible and the spark cycle duration should be high (i.e., the spark frequency should be low) to allow stable cutting of the porous metal and to prevent smearing. In addition, more stable cutting was found to occur for thin materials only when the wire tension is high and the wire electrode speed is low. For a Brother Cont HS-300 wire EDM machine, optimum machining parameters were found to be: cutting speed=381 microns/minute, spark cycle=30 micro-seconds, spark energy=20%, wire speed=20%, wire tension=80%, wire conductivity=66.7% and wire type=brass, 0.25 mm diameter.

For a sink EDM machine, it was found that the cutting speed, spark frequency, power and current capacity should be as low as possible and the off time should be high and the on time should be low so as to yield fabricated nozzles with minimum pore smearing on their surfaces.

Since the EDM machining process causes a recast layer of carbon to be deposited on the surface of the porous medium, the above cutting parameters also ensured that deposition amounts were minimal. In addition, it proved to be advisable to remove these carbon deposits by ultrasonically cleaning the nozzles in an alcohol bath and then heating them to vaporize any alcohol remnants.

In general, the optimized wire EDM machine was found to cause less clogging of the pores on the surface of the porous metals than for a comparably optimized sink EDM machine. However, with a wire EDM machine it was not always possible to conveniently fabricated the desired nozzle shapes. Thus, for an axisymmetric nozzle, a wire EDM machine was used to fabricated the nozzle's exterior surface and a sink EDM machine was used to fabricate the nozzle's interior surfaces.

In use, the pressure in the lubricant chamber 14 is higher than the pressure in the nozzle 16. The pressure differential may be achieved by a difference in applied pressure, or by a difference in flow rates between the lubricant chamber 14 and the nozzle 16. As a result of this pressure difference, lubricant is forced continuously through the porous structure of the nozzle 16 to provide a thin protective layer (film) on the inner wall of the nozzle 16. Since the lubricant is constantly replenished from the lubricant chamber 14, sites where abrasive particles "gouge" the film are "repaired", reducing or preventing damage to the solid walls.

Experiments were undertaken to determine the amount of wear reduction achievable with various lubricants and lubricant flow rates. For an axisymmetric nozzle having an internal diameter of approximately 200 microns, garnet particles with a nominal size of 25 microns were used with water as the carrier fluid. The slurry concentration in the slurry chamber 6 was $4.4\times10^{-3}$ g/cm$^3$. The upstream pressure was 14.5 MPa and the run time was 1 hour and 45 minutes. The typical water flow rate was $3.5\times10^{-6}$ m$^3$/sec. Oils with three different kinematic viscosities, 460 mm$^2$/sec, 1800 mm$^2$/sec and 4000 mm$^2$/sec (at 25 degrees C.), were used as lubricants. Other high viscosity liquids could have been used, such as liquid polymers and silicone fluids.

The viscosities of the oils are seen to be much higher than the viscosity of the carrier fluid, which is water and, at 25 degrees C., has a kinematic viscosity of 0.89 mm$^2$/sec. In general, the viscosity of the lubricant can be in the range of 100–40,000 times larger than the viscosity of the carrier fluid.

Scanning Electron Microscope (SEM) images of the nozzle exit were taken before and after an erosion test to determine the percent increase in the nozzle's diameter. Without a lubricant flowing through the porous nozzle, the percentage wear in the nozzle's diameter was 111% (202 to 426 microns during the 1 hour and 45 minute erosion test).

Figure 7:
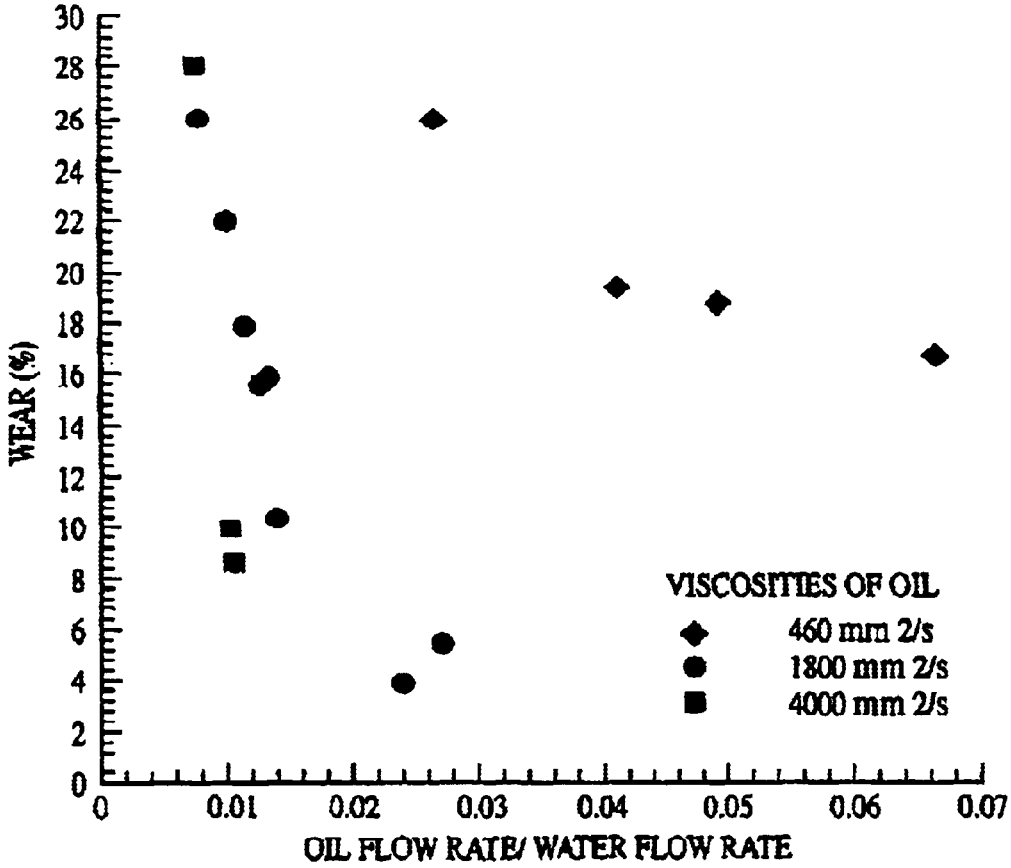
FIG. 7 displays the results of erosion wear of an axisymmetric nozzle at different lubricant flow rates and viscosities.

FIG. 7 displays the results of these erosion experiments. As expected, the percentage wear in the nozzle's diameter decreases as the lubricant's flow rate or viscosity increases. Extrapolation of these results suggests that a 4,000 mm$^2$/sec lubricant would require a percentage lubricant to water flow rate of only about 1.5% to reduce the nozzle's wear erosion to 4% over a test's 1 hour and 45 minute duration. In general, the lubricant flow rate will be in the range of 1/10,000 to 1/20 of that of the carrier fluid flow rate.

Figure 8:
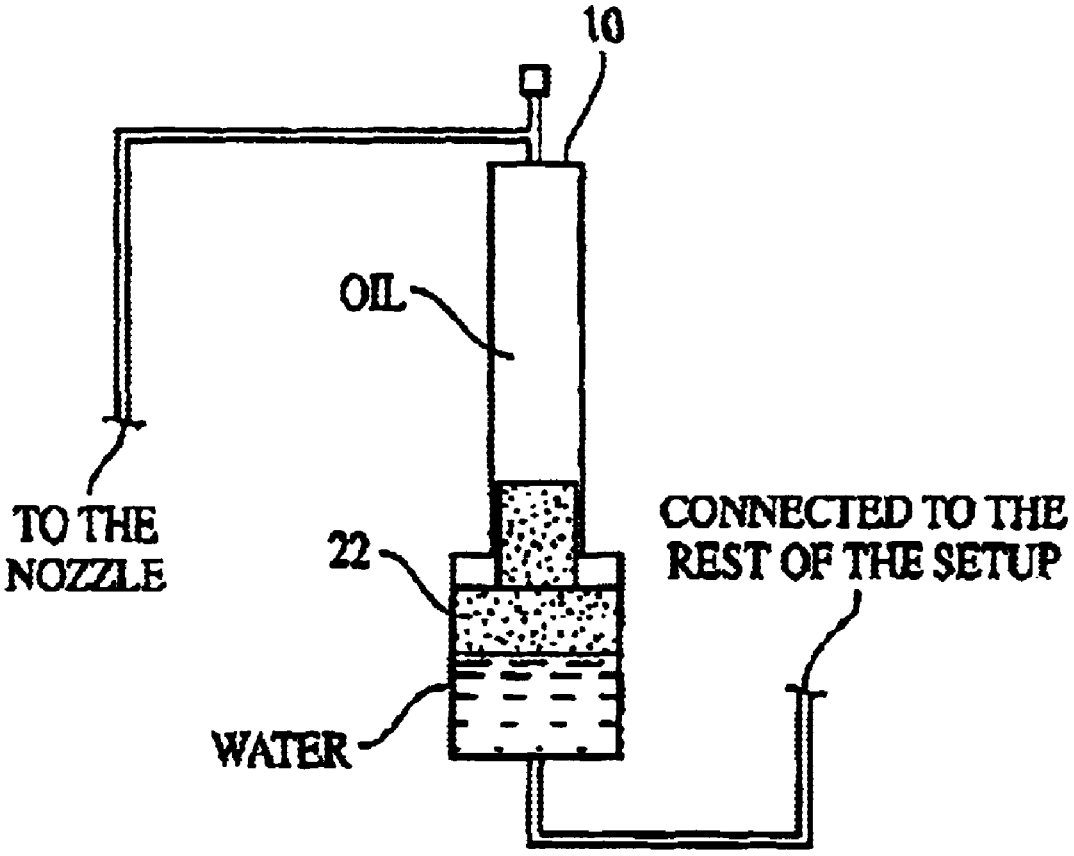
FIG. 8 displays a fluid pressure intensifier suitable for placement in the lubricant's input piping line.

From examining the wear patterns along the axis of the nozzle, considerable erosion could be seen at the nozzle's entrance where the carrier fluid has not yet accelerated so as to provide a sufficient pressure difference to drive the lubricant flow thorough the porous nozzle. This suggests that it may be beneficial to increase the pressure in the lubricant chamber 14 surrounding the nozzle 16 beyond that attainable by directly using the same pressure source for both the carrier fluid and the lubricant. This can easily be achieved by using an intensifier 22 in the lubricant's input piping line. See FIG. 8.

In addition, the research associated with the development of the present invention revealed that it was advisable to use a piston 24 to separate the water from the lubricant in the lubricant source. This piston ensures that the lubricant and the carrier fluid do not mix and form an emulsion. Recall that an emulsion is formed when two immiscible liquids are mixed together and one of the liquids forms droplets dispersed in the other. There is substantial evidence that the permeability of a porous medium is reduced due to the transport of emulsions through them which is detrimental to the flow of lubricant and the consequent formation of the film on the nozzle walls.

The high viscosity lubricant can be of any desired type, so long as the lubricant creates a protective film on the inner wall of the nozzle 16. Use of liquid polymers provides an additional advantage in situations involving high shear strains ($>10^7$) like those occurring in the nozzle 16, since liquid polymers tend to "harden" under such conditions (that is, become less of a viscous material and more of a plastic solid). Thus, liquid polymers can absorb much more energy and stresses from laterally moving abrasive particles. Synthetic lubricants (such as poly alfa olefins) which have sufficiently high viscosity and can be drawn or forced through a porous medium should provide sufficient protection to the walls of the nozzle 16 under normal conditions.

With lubricated walls, the diameter of the nozzle 16 can be substantially decreased to sizes that are only slightly larger than the particle diameter. For example, if the maximum particle diameter is about 20 microns, the nozzle diameter in principle can be reduced to about 40 microns, including the oil film. A smaller nozzle diameter provides sharper and more precise cuts with less material loss. As a further consequence of lubricating the nozzle walls exposed to the slurry, the slurry velocity can be increased to considerably higher speeds without damage to the nozzle walls, thereby increasing the abrasive power of the slurry and the cutting efficiency of the system.

The ability to premix the abrasive particles and the carrier fluid within the slurry mixing chamber 4 and nozzle 16 without fear of damage to the nozzle walls has an additional major advantage. Provided that the nozzle 16 is long enough (based on a relatively simple analysis that depends on the nozzle geometry and the abrasive particle specific gravity, which is higher than the carrier fluid), the abrasive particles can be accelerated to approximately the same speed as the fluid. Consequently, the speed and abrasive power of each particle can be maximized. Additionally, it should be noted that the abrasive slurry jet issuing from the nozzle exit is coherent which improves its cutting accuracy as well as making micro-machining tasks feasible.

Although the foregoing disclosure relates to preferred embodiments of the invention, it is understood that these details have been given for the purposes of clarification only. Various changes and modifications of the invention will be apparent, to one having ordinary skill in the art, without departing from the spirit and scope of the invention as hereinafter set forth in the claims.

We claim:

1. A method for reducing erosion on the inner wall of a nozzle for an abrasive fluid jet cutting system said erosion due to an abrasive slurry flowing from said nozzle's inlet port, along said nozzle's wall and exiting through said nozzle's outlet port, said method comprises the steps of:

forming said nozzle so that at least a portion of it is porous, surrounding said porous portion of the outer wall of said nozzle with a lubricating fluid chamber, forcing lubricating fluid to pass from said lubricating chamber and through said porous wall to form a lubricating film between said nozzle inner wall and said flow of abrasive slurry, wherein said lubrication fluid having been filtered to eliminate contaminants from said lubricating fluid that might clog the pores of said porous portion of said nozzle.

2. A method as recited in claim 1, wherein the smallest cross sectional dimension of the passage connecting said nozzle inlet and outlet port is in the range of 50–3,000 microns.

3. A method as recited in claim 1, wherein said abrasive particles have an average diameter of approximately less than half of the smallest cross sectional dimension of the passage connecting said nozzle inlet and outlet ports.

4. A method as recited in claim 1, wherein said lubricating fluid having a kinematic viscosity whose ratio with the kinematic viscosity of said carrier fluid is in the range of 100/1–40,000/1.

5. A method as recited in claim 1, wherein said lubricating fluid has a flow rate whose ratio with the flow rate of the carrier fluid is in the range of 1/10,000–1/20.

6. A method as recited in claim 1, wherein the thickness of said nozzle wall varies along its length to control the flow rate of the lubricating fluid.

7. A method as recited in claim 1, wherein the porosity of said nozzle wall varies along its length to control the flow rate of the lubricating fluid.

8. A method as recited in claim 1, wherein said porous portion of said nozzle wall being fabricated from a porous metal.

9. A method as recited in claim 1, wherein the passage connecting said nozzle inlet and outlet port is made by a process selected from the group consisting of casting, molding and machining processes for said porous metal.

10. A method as recited in claim 1, wherein said porous portion of said nozzle having been fabricated from a gravity sintered, porous metal.

11. A method as recited in claim 10, wherein said porous portion of said nozzle having been machined to size by utilizing electric discharge machining techniques.

12. A method as recited in claim 11, wherein electric discharge techniques employed include setting said machine cutting speed, spark frequency and spark energy level to values that are within the bottom 25% of said machine's operational capabilities.

13. A method as recited in claim 1, wherein said porous portion of said nozzle being fabricated from a porous ceramic material.

14. A method as recited in claim 1, wherein the passage connecting said nozzle inlet and outlet ports is made by a process selected from the group consisting of casting, molding and machining processes for said porous ceramic material.

15. A method as recited in claim 1, further comprising the step of providing a means, connected to an input pipe for said lubricating chamber, for utilizing the driving pressure on said carrier fluid to increase the pressure in said chamber to approximately the same level of pressure as that which drives said carrier fluid, said means having a means for separating said lubricating fluid from said carrier fluid so as to prevent mixing and emulsion formation.

16. A method as recited in claim 15, further comprising the step of providing a means, connected to said lubricating chamber input pipe, for increasing the pressure in said chamber above the level of the pressure which drives said carrier fluid.

17. A method as recited in claim 1, wherein said lubricating fluid is chosen from a group consisting of a liquid polymer, silicone fluids such as Dow Corning 200 fluid or a chemical such as glycerin.

18. A method as recited in claim 1, wherein the lubricating fluid is an oil.

19. A nozzle apparatus for use with an abrasive fluid jet cutting system, said nozzle apparatus comprising:

a nozzle having an entry port for receiving a slurry consisting of a carrier fluid and abrasive particles, an inner wall for directing the flow of said slurry, and an outlet port through which said slurry exits said nozzle, wherein at least a portion of said nozzle wall being porous, a lubricating fluid chamber that surrounds said porous portion of the outer wall of said nozzle, said chamber having a port where a lubricating fluid enters said chamber, said chamber port connecting to an input pipe which connects to a filter for filtering contaminants from said lubricating fluid that might clog the pores of said porous portion of said nozzle, and wherein said lubricating fluid passes from said lubricating fluid chamber and through said porous wall to lubricate at least a portion of the surface of said nozzle inner wall.

20. A nozzle apparatus as recited in claim 19, wherein the smallest cross sectional dimension of the passage connecting said nozzle inlet and outlet port is in the range of 50–3,000 microns.

21. A nozzle apparatus as recited in claim 19, wherein said abrasive particles have an average diameter of approximately less than half of the smallest cross sectional dimension of the passage connecting said nozzle inlet and outlet ports.

22. A nozzle apparatus as recited in claim 19, wherein said lubricating fluid having a kinematic viscosity whose ratio with the kinematic viscosity of said carrier fluid is in the range of 100/1–40,000/1.

23. A nozzle apparatus as recited in claim 19, wherein said lubricating fluid has a flow rate whose ratio with the flow rate of the carrier fluid is in the range of 1/10,000–1/20.

24. A nozzle apparatus as recited in claim 19, wherein the thickness of said nozzle wall varies along its length to control the flow rate of the lubricating fluid.

25. A nozzle apparatus as recited in claim 19, wherein the porosity of said nozzle wall varies along its length to control the flow rate of the lubricating fluid.

26. A nozzle apparatus as recited in claim 19, wherein said porous portion of said nozzle wall being fabricated from a porous metal.

27. A nozzle apparatus as recited in claim 19, wherein the passage connecting said nozzle inlet and outlet port is made by a process selected from the group consisting of casting, molding and machining processes for said porous metal.

28. A nozzle apparatus as recited in claim 19, wherein said porous portion of said nozzle having been fabricated from a gravity sintered, porous metal.

29. A nozzle apparatus as recited in claim 28, wherein said porous portion of said nozzle being machined to size by utilizing electric discharge machining techniques.

30. A nozzle apparatus as recited in claim 29, wherein electric discharge techniques employed include setting said machine cutting speed, spark frequency and spark energy level to values that are within the bottom 25% of said machine's operational capabilities.

31. A nozzle apparatus as recited in claim 19, wherein said porous portion of said nozzle being fabricated from a porous ceramic material.

32. A nozzle apparatus as recited in claim 31, wherein the passage connecting said nozzle inlet and outlet ports is made by a process selected from the group consisting of casting, molding and machining processes for said porous ceramic material.

33. A nozzle apparatus as recited in claim 19, further comprising a means, connected to said lubricating chamber input pipe, for utilizing the driving pressure on said carrier fluid to increase the pressure in said chamber to approximately the same level of pressure as that which drives said carrier fluid, said means having a means for separating said lubricating fluid from said carrier fluid so as to prevent mixing and emulsion formation.

34. A nozzle apparatus as recited in claim 33, further comprising a means, connected to said lubricating chamber input pipe, for increasing the pressure in said chamber above the level of the pressure which drives said carrier fluid.

35. A nozzle apparatus as recited in claim 19, wherein said lubricating fluid is chosen from a group consisting of a liquid polymer, silicone fluids such as Dow Corning 200 fluid or a chemical such as glycerin.

36. A nozzle apparatus as recited in claim 19, wherein the lubricating fluid is an oil.

37. An abrasive fluid jet cutting system comprising:

a source of pressurized slurry consisting of a carrier fluid and abrasive particles, a source of pressurized lubricating fluid, a nozzle having an entry port for connecting to said slurry source and receiving said slurry, an inner wall for directing the flow of said slurry, and an outlet port through which said slurry exits said nozzle, wherein at least a portion of said nozzle wall being porous, a lubricating fluid chamber that surrounds said porous portion of the outer wall of said nozzle, said chamber having a port for connecting to an input pipe that connects to said lubricating fluid source, said input pipe also connecting to a filter for filtering contaminants from said lubricating fluid that might clog the pores of said porous portion of said nozzle, and wherein said lubricating fluid passes from said lubricating reservoir and through said porous wall to lubricate at least a portion of the surface of said nozzle wall.

38. An abrasive fluid jet cutting system as recited in claim 37, wherein the smallest cross sectional dimension of the passage connecting said nozzle inlet and outlet port is in the range of 50–3,000 microns.

39. An abrasive fluid jet cutting system as recited in claim 37, wherein said abrasive particles have an average diameter of approximately less than half of the smallest cross sectional dimension of the passage connecting said nozzle inlet and outlet ports.

40. An abrasive fluid jet cutting system as recited in claim 37, wherein said lubricating fluid having a kinematic viscosity whose ratio with the kinematic viscosity of said carrier fluid is in the range of 100/1–40,000/1.

41. An abrasive fluid jet cutting system as recited in claim 37, wherein said lubricating fluid has a flow rate whose ratio with the flow rate of the carrier fluid is in the range of 1/10,000–1/20.

42. An abrasive fluid jet cutting system as recited in claim 37, wherein the thickness of said nozzle wall varies along its length to control the flow rate of the lubricating fluid.

43. An abrasive fluid jet cutting system as recited in claim 37, wherein the porosity of said nozzle wall varies along its length to control the flow rate of the lubricating fluid.

44. An abrasive fluid jet cutting system as recited in claim 37, wherein said porous portion of said nozzle wall being fabricated from a porous metal.

45. An abrasive fluid jet cutting system as recited in claim 37, wherein the passage connecting said nozzle inlet and outlet port is made by a process selected from the group consisting of casting, molding and machining processes for said porous metal.

46. An abrasive fluid jet cutting system as recited in claim 37, wherein said porous portion of said nozzle having been fabricated from a gravity sintered, porous metal.

47. An abrasive fluid jet cutting system as recited in claim 46, wherein said porous portion of said nozzle having been machined to size by utilizing electric discharge machining techniques.

48. An abrasive fluid jet cutting system as recited in claim 47, wherein electric discharge techniques employed include setting said machine cutting speed, spark frequency and spark energy level to values that are within the bottom 25% of said machine's operational capabilities.

49. An abrasive fluid jet cutting system as recited in claim 37, wherein said porous portion of said nozzle being fabricated from a porous ceramic material.

50. An abrasive fluid jet cutting system as recited in claim 49, wherein the passage connecting said nozzle inlet and outlet ports is made by a process selected from the group consisting of casting, molding and machining processes for said porous ceramic material.

51. An abrasive fluid jet cutting system as recited in claim 37, further comprising a means, connected to said lubricating chamber input pipe, for utilizing the driving pressure on said carrier fluid to increase the pressure in said chamber to approximately the same level of pressure as that which drives said carrier fluid, said means having a means for separating said lubricating fluid from said carrier fluid so as to prevent mixing and emulsion formation.

52. An abrasive fluid jet cutting system as recited in claim 51, further comprising a means, connected to said lubricating chamber input pipe, for increasing the pressure in said chamber above the level of the pressure which drives said carrier fluid.

53. An abrasive fluid jet cutting system as recited in claim 51, wherein said lubricating fluid is chosen from a group consisting of a liquid polymer, silicone fluids such as Dow Corning 200 fluid or a chemical such as glycerin.

54. An abrasive fluid jet cutting system as recited in claim 37, wherein the lubricating fluid is an oil.

* * * * *